US007107626B1

(12) United States Patent
Andrews

(10) Patent No.: US 7,107,626 B1
(45) Date of Patent: Sep. 19, 2006

(54) YOGA SOCKS

(76) Inventor: Elizabeth M. Andrews, 5 Butterfield Cir., Flossmoor, IL (US) 60422

( * ) Notice: Subject to any disclaimer, the term of this patent is extended or adjusted under 35 U.S.C. 154(b) by 0 days.

(21) Appl. No.: 10/681,616

(22) Filed: Oct. 8, 2003

(51) Int. Cl.
*A43B 17/00* (2006.01)
*A41B 11/00* (2006.01)

(52) U.S. Cl. ..... 2/239

(58) Field of Classification Search ..... 2/239–242, 2/409, 161.3, 161.8, 163; 66/185, 178 R, 66/172 E, 186, 187; 602/23; 36/94
See application file for complete search history.

(56) References Cited

U.S. PATENT DOCUMENTS

| | | | | | |
|---|---|---|---|---|---|
| 715,543 | A * | 12/1902 | Bosworth | 2/239 |
| 1,543,353 | A * | 6/1925 | Wolff | 2/61 |
| 1,999,929 | A * | 4/1935 | Hearn | 2/239 |
| 2,332,252 | A * | 10/1943 | Payne | 36/106 |
| 2,424,056 | A * | 7/1947 | Ruth | 2/241 |
| 2,629,996 | A * | 3/1953 | Hamilton | 66/172 R |
| 2,771,691 | A * | 11/1956 | Luchs | 36/10 |
| 4,104,892 | A * | 8/1978 | Thorneburg | 66/185 |
| 4,476,858 | A * | 10/1984 | Curtis | 602/23 |
| 4,651,354 | A * | 3/1987 | Petrey | 2/239 |
| 4,728,538 | A * | 3/1988 | Kaspar et al. | 427/288 |
| 5,054,129 | A * | 10/1991 | Baehr | 2/409 |
| 5,623,734 | A * | 4/1997 | Pugliatti | 2/239 |
| 5,682,617 | A * | 11/1997 | Tumas | 2/239 |
| 5,708,985 | A * | 1/1998 | Ogden | 2/239 |
| 5,737,776 | A * | 4/1998 | Jennings | 2/409 |
| 5,867,838 | A * | 2/1999 | Corry | 2/239 |
| 6,138,281 | A * | 10/2000 | Chiaruttini | 2/239 |
| 6,226,800 | B1 * | 5/2001 | Islar | 2/239 |
| 6,275,997 | B1 * | 8/2001 | Richardson | 2/239 |
| 6,385,779 | B1 * | 5/2002 | Boersema | 2/239 |
| 6,704,941 | B1 * | 3/2004 | Palm | 2/239 |
| 2002/0000003 | A1 * | 1/2002 | Boersema | 2/239 |
| 2003/0074718 | A1 * | 4/2003 | English | 2/239 |
| 2005/0091729 | A1 * | 5/2005 | Alley | 2/239 |
| 2005/0144703 | A1 * | 7/2005 | Hilbert | 2/239 |

* cited by examiner

*Primary Examiner*—Alissa L. Hoey
(74) *Attorney, Agent, or Firm*—Thomas R. Vigil; Welsh & Katz, Ltd.

(57) ABSTRACT

The sock is particularly adapted for use in Yoga exercises, Pilate exercises, stretching and other mat-based exercises, and comprises a sock made of a natural, plastic or synthetic fiber. The sock has five toe holes in the front end with webbing extending between the toe holes from the top of the sock to the bottom or sole of the sock to provide these openings through which the toes of a user can extend. The sock also has a layer of a PVC vinyl material on the bottom or sole of the sock which has a sticky or friction characteristic to enable the sock to grip a floor or mat when used by an exerciser, with or without the use of a mat, and to allow the toes to be exposed for tack or gripping functions.

5 Claims, 2 Drawing Sheets

14
12
10
22
36
20
26
28
18
16

14
36
22
12
24
28
16
18

YOGA SOCKS

BACKGROUND OF THE INVENTION

1. Field of the Invention

The present invention relates to socks that are adapted to be used in practicing Yoga, pilates or stretch exercises. They are referred to as Yoga sticky socks and have a sticky sole or bottom surface and holes for each of the toes to be exposed.

2. Description of the Prior Art

Heretofore, socks that are intended to be worn when exercising have been provided with rows of rubber dots or bumps which will enable the sock to grip a mat or floor.

Also, sticky mats are typically used while practicing Yoga. They have a sticky rubber surface. A user currently performs Yoga with bare feet and practices Yoga on a sticky mat that is intended to prevent the user from slipping during the exercises.

One example of a Yoga mat is disclosed in U.S. Patent Publication No. US 2002/0098947.

BRIEF SUMMARY OF THE INVENTION

The present invention is directed to socks, namely sticky socks, which are meant to be worn when practicing Yoga, Pilates, stretch and other mat-based exercises. Yoga and Pilates are exercise programs that involve balancing and stretching movements. In the past, while performing these exercises, the exerciser usually used a thin sticky rubberized mat and bare feet. The mat was intended to prevent the person from slipping during the exercises.

The socks of the present invention are specially designed to provide an appropriate friction/stickiness on the feet with toe exposure, with or without the use of a mat, for these exercises.

According to the present invention there is provided a sock, particularly adapted for use in Yoga exercises, Pilate exercises, stretching and other mat-based exercises. The sock is made of a natural, plastic or synthetic fiber. The sock has individual holes for each toe in the front of the sock. The sock also has a layer of a PVC vinyl material on the bottom or sole of the sock which has a sticky or friction characteristic to enable the sock to grip a floor or mat when used by an exerciser, with or without the use of a mat, and to allow the toes to be exposed for tack or gripping functions, as well as for the user to hold onto with their hands in certain positions.

DETAILED DESCRIPTION OF THE INVENTION

Figure 1:
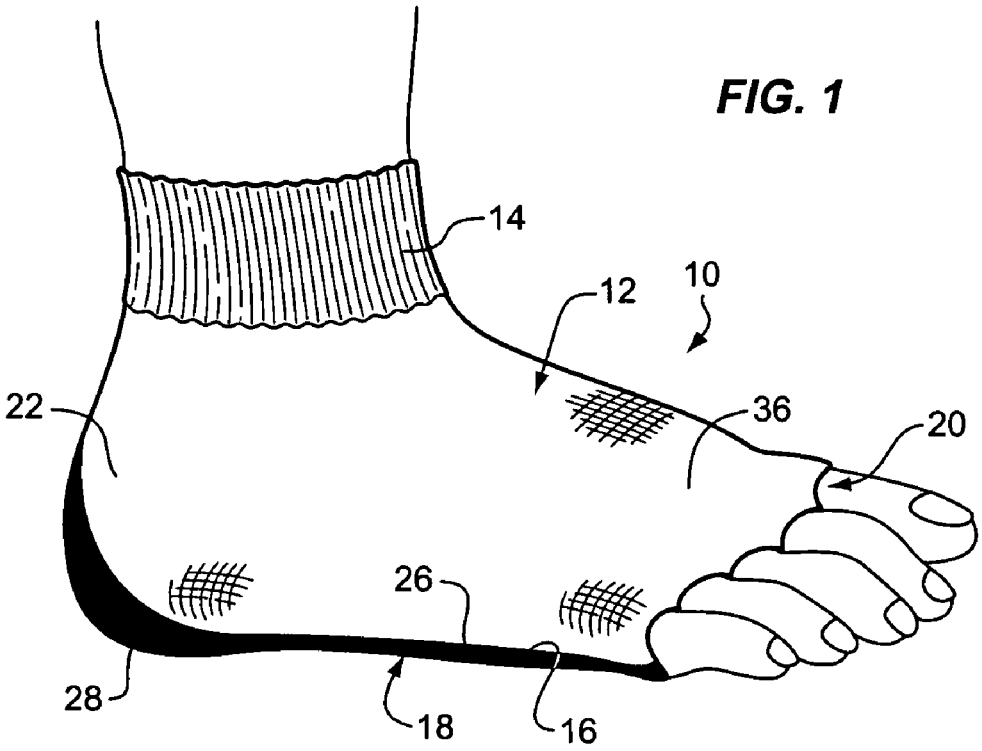
FIG. 1 is a front elevational view of an outer side of a right foot of a user wearing a sock constructed according to the teachings of the present invention.

Referring now to the drawings in greater detail there is shown in FIG. 1 a right foot 10 of a user of a sock 12 which is constructed according to the teachings of the present invention and which is mounted on the foot 10.

In this embodiment, the sock 12 has a short ankle band 14 and is made of a woven natural, plastic, or artificial fiber. It is to be noted that the ankle band 14 is optional. As shown, a bottom or sole 16 of the sock 12 has a thin layer of a rubbery substance 18, such as a PVC vinyl material 18, thereon.

Figure 2:
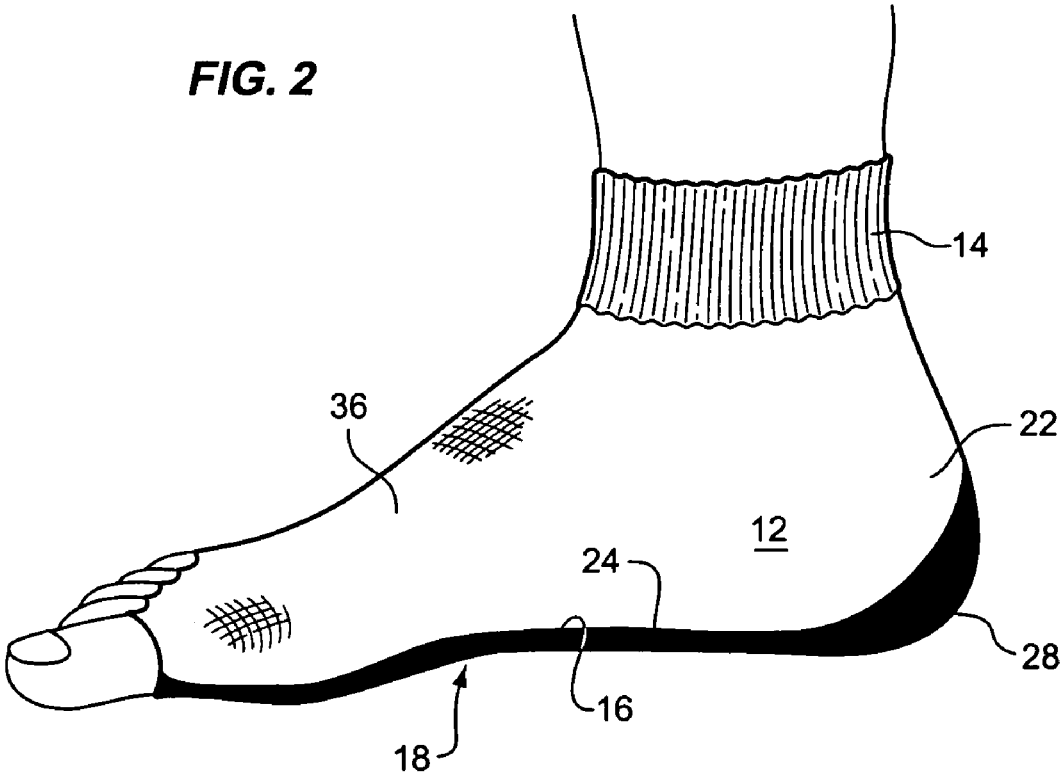
FIG. 2 is an inside elevational view of the right foot of the user shown in FIG. 1 wearing the sock constructed according to the teachings of the present invention.
Figure 3:
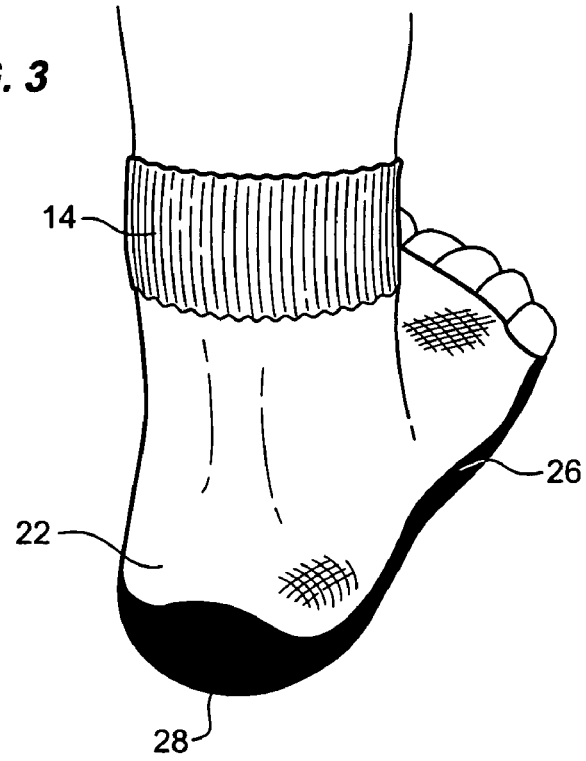
FIG. 3 is a back elevational view of the foot and sock shown in FIGS. 1 and 2; and, FIG. 4 is a front elevational view of the sock shown in FIG. 1 but without the foot of the user and showing spaced apart webbings extending from the top of the sock to the bottom of the sock for establishing toe holes for the toe of the user.

The layer of a rubbery substance 18 extends from an open front 20 of the sock 12, which is open to permit the toes of a user to extend from the open front end 20 of the sock 12 sock to a heal 22 of the sock 12 as shown in FIGS. 1 and 2.

Figure 4:
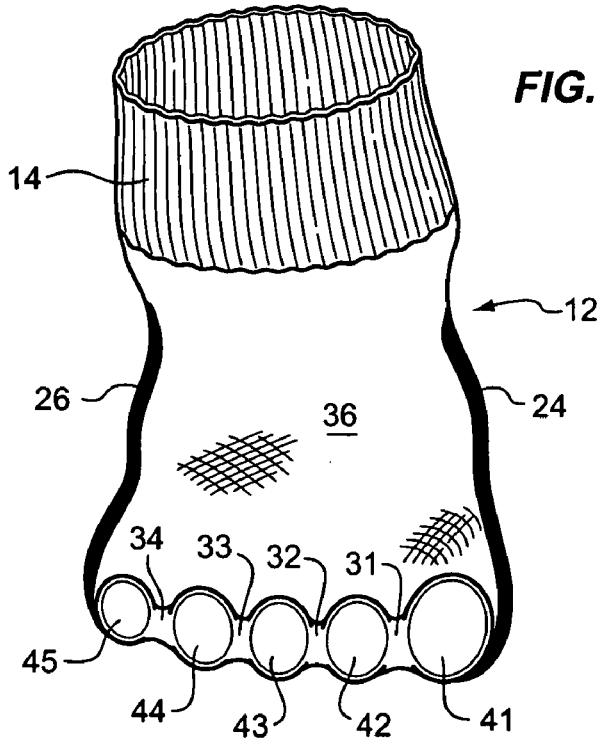

The layer of rubbery substance 18 extends slightly upwardly on each side of the sock as shown at 24 and 26 in FIG. 4.

The layer of rubbery substance 18 extends from the front 20 of the sock 12 through the heel 22, as shown at 28.

The short ankle band 14 is shown in the figures. However, it should be understood that the sock 12 also can be an ankle or calf sock that extends over the ankle or even up onto the calf to an elastic band or the sock can be constructed without an ankle band or the ankle band can be higher and form a calf band. The overall height may even be lower than the ankle with or without an ankle band.

The thickness of the rubbery substance 18 can be between 0.0625 inch and 0.250 inch with a preferred thickness being approximately 0.125 inch, i.e., ⅛ inch.

The rubbery substance 18 can be PVC vinyl material which, preferably, is made from the same material used in forming Yoga sticky mats which material is referred to as a "closed cell PVC vinyl material—100% latex free." This material is also referred to as a vinyl sponge foam material. Of course, any other sticky rubbery material may be used in place of the PVC vinyl material.

As best shown in FIG. 4 the open front end front 20 of the sock 12 does not cover the toes. Instead, the sock 12 has four webbings of sock material 31–34 extending from a top 36 of the sock to the bottom or sole 16 of the sock 12 thereby to form five toe holes 41–45 through which the toes of the user can extend.

With this construction, a user has a feeling for the mat or floor surface with their toes but yet has the layer of sticky PVC vinyl material 18 on the bottom or sole 16 of the sock to prevent slipping.

It will be understood, that a pair of the socks 12, namely, a right foot and a left foot of the sock are provided in a pair of the socks 12 intended for use in practicing Yoga. Typically, the socks 12 are ankle length knit gym socks having individual holes 41–45 for each of the toes to come through. The holes 41–45 allow the toes to be exposed for tack or gripping functions and allow for better stability of the sock 12 on the foot 10 (right or left). Further it will be understood, that the bottom or sole 16 of the sock 12 is covered with the sticky rubber material 18 which is similar to the sticky rubber material in a standard Yoga sticky rubber mat, thus providing a sticky grip surface. The sock 12 itself can be made from a variety of materials including cotton, acrylic and all types of synthetic blends. The sock 12 may or may not have lacing or strapping for fit or stability.

The Yoga sock 12 of the present invention, has advantages over the current system of a bare foot used on a sticky mat. These advantages are that the sock provides absorption of sweat from the feet; eliminates or reduces the transmitting or receiving of foot fungal infections from communal use of mats; is easily portable; is easily washed; and provides superior gripping.

Further, the Yoga socks 12 of the present invention are designed to keep the ankle muscles of the user warm while providing for maximum range of motion, flexibility, and sure footing. In addition, the Yoga socks are intended to provide a hygienic alternative to the use of bare feet.

From the foregoing description, it will be apparent that modifications can be made to the socks 12 of the present invention without departing from the teachings of the invention.

Also it will be apparent that that the Yoga socks of the present invention have a number of advantages, some which have been described above and others of which are inherent in the invention. Accordingly, the scope of the present invention is only to be limited as necessitated by the accompanying claims.

I claim:

1. A sock particularly adapted for use in Yoga exercises, Pilate exercises, stretching and other mat-based exercises, comprising:

a sock made of a natural, plastic or synthetic fiber, said sock having an open front end with webbings extending across the open front end from a top of the sock to a bottom or sole of the sock to provide openings through which the toes of a user can extend, the webbings including four spaced apart webbings extending across the open front end between the top of the sock to the bottom or sole of the sock to provide five specific toe hole openings in the front end of the sock for receiving the toes of a user, and said sock having a generally continuous layer of a rubbery substance with a sticky soft surface extending across the bottom or sole of the sock and extending upwardly on the heel and on each side of the sock a short distance, providing a non-slip function and having a thickness of between 0.065 inch and 0.25 inch to enable the sock to grip a floor or mat when used by an exerciser, with or without the use of a mat, and to allow the toes to be exposed for tack or gripping functions.

2. The sock of claim 1, wherein said layer of a rubbery substance is a closed cell PVC vinyl material.

3. The sock of claim 1, wherein said layer of a rubbery substance is a vinyl sponge foam material.

4. The sock of claim 1, wherein the thickness of said layer of a rubbery substance is approximately 0.125 inch.

5. A sock particularly adapted for use in Yoga exercises, Pilate exercises, stretching and other mat-based exercises, comprising:

a sock made of a natural, plastic or synthetic fiber, said sock having an open front end with webbings extending across the open front end from a top of the sock to a bottom or sole of the sock to provide openings through which the toes of a user can extend, the webbings including four spaced apart webbings extending across the open front end between the top of the sock to the bottom or sole of the sock to provide five specific toe hole openings in the front end of the sock for receiving the toes of a user and said sock having a generally continuous, non-skid structure which extends across the sole thereof, which extends upwardly on the heel and on each side of the sock a short distance and which has a sticky soft surface that provides a non-slip function and has a thickness of between 0.065 inch and 0.25 inch to enable the sock to grip a floor or mat when used by an exerciser, with or without the use of a mat, and to allow the toes to be exposed for tack or gripping functions.

* * * * *